US011105147B2

(12) United States Patent
Teicher et al.

(10) Patent No.: US 11,105,147 B2
(45) Date of Patent: Aug. 31, 2021

(54) SLIDING DOOR DRAFT PREVENTION DEVICE

(71) Applicant: UNIVERSAL SCREEN ARTS, INC., Hudson, OH (US)

(72) Inventors: Keith Teicher, Hudson, OH (US); Sheri Borovitz-Linda, Hudson, OH (US)

(73) Assignee: Universal Screen Arts, Inc., Hudson, OH (US)

( * ) Notice: Subject to any disclaimer, the term of this patent is extended or adjusted under 35 U.S.C. 154(b) by 141 days.

(21) Appl. No.: 16/580,454

(22) Filed: Sep. 24, 2019

(65) Prior Publication Data

US 2020/0095824 A1 Mar. 26, 2020

Related U.S. Application Data

(60) Provisional application No. 62/736,567, filed on Sep. 26, 2018.

(51) Int. Cl.
*E06B 7/23* (2006.01)

(52) U.S. Cl.
CPC ..... *E06B 7/2316* (2013.01); *E06B 7/2314* (2013.01)

(58) Field of Classification Search
None
See application file for complete search history.

(56) References Cited

U.S. PATENT DOCUMENTS

| | | | | |
|---|---|---|---|---|
| 4,765,094 | A * | 8/1988 | Gemmell | E06B 7/16 49/475.1 |
| 6,560,932 | B2 * | 5/2003 | Heroux | E06B 7/2316 49/467 |
| 7,891,136 | B1 * | 2/2011 | Heroux | E06B 7/2316 49/470 |
| 8,141,298 | B2 * | 3/2012 | Heroux | E06B 7/2316 49/470 |
| 8,161,685 | B2 * | 4/2012 | Salgado | E06B 7/2316 49/470 |
| 8,701,350 | B2 * | 4/2014 | Vulpitta | E06B 7/26 49/470 |
| 8,733,019 | B2 * | 5/2014 | Vulpitta | E06B 7/2316 49/70 |
| 2003/0126826 | A1 * | 7/2003 | Marshall | E04G 21/30 52/718.01 |
| 2006/0032144 | A1 * | 2/2006 | Heroux | E06B 7/2316 49/469 |

(Continued)

FOREIGN PATENT DOCUMENTS

| | | | | |
|---|---|---|---|---|
| DE | 102007003905 | A1 * | 8/2007 | E06B 7/16 |
| EP | 3181796 | B1 * | 10/2018 | E06B 7/26 |

(Continued)

*Primary Examiner* — Marcus Menezes
(74) *Attorney, Agent, or Firm* — Fay Sharpe LLP

(57) ABSTRACT

The present disclosure relates to a draft stopper for a sliding door system. The draft stopper including a longitudinally extending body having a front end, a rear end, a top, and a bottom with a longitudinally extending flap portion hingedly attached to the top of the body. The longitudinally extending flap portion is configured to substantially fill a recess of the sliding door system in an engaged position and abut at least one door of the sliding door system preventing drafting air from entering a structure.

20 Claims, 4 Drawing Sheets

(56) References Cited

U.S. PATENT DOCUMENTS

| | | | | |
|---|---|---|---|---|
| 2010/0192468 | A1* | 8/2010 | Chubb | E06B 7/2314<br>49/407 |
| 2011/0283627 | A1* | 11/2011 | Shaw | E06B 7/2316<br>49/478.1 |
| 2012/0222361 | A1* | 9/2012 | Farucci | E06B 7/2316<br>49/475.1 |
| 2013/0276376 | A1* | 10/2013 | Gilbert | E06B 1/70<br>49/469 |
| 2014/0190099 | A1* | 7/2014 | Hopkins, II | E06B 7/231<br>52/204.5 |

FOREIGN PATENT DOCUMENTS

| | | | | |
|---|---|---|---|---|
| FR | 2675532 | A1 * | 10/1992 | E06B 7/2314 |
| GB | 1079667 | A * | 8/1967 | E06B 7/2316 |
| GB | 2109447 | A * | 6/1983 | E06B 7/2316 |
| WO | WO-2006020771 | A2 * | 2/2006 | E06B 7/2316 |

* cited by examiner

SLIDING DOOR DRAFT PREVENTION DEVICE

CLAIM OF PRIORITY

This application claims priority from Provisional Application Ser. No. 62/736,567, filed on Sep. 26, 2018, the entirety of which is hereby incorporated by reference.

BACKGROUND OF THE DISCLOSURE

The present disclosure relates a device to prevent drafts from entering a structure. It finds particular application in conjunction with sliding door systems and preventing drafting air, bugs, dust, and unwanted odors from entering a building or residence originating from the outside environment and further assisting in the temperature regulation of the structure. However, it is to be appreciated that the present exemplary embodiment is also amenable to other like applications.

Sliding door systems are installed in many residential and commercial structures as a way of providing access into and out of the structure. Door systems of this type are usually double door systems wherein each door is provided with at least one glass pane closed within a metal or plastic border. Generally, one door is fixed and the other is slidable between open and closed positions within the frame of the door system. That is, the sliding door includes a frame including a plurality of adjacent tracks where each track is associated with at least one door that is slidably attached within the frame. The door system provides access to outside by sliding a door along the track to an open position.

The base of the sliding door system, where each door contacts the track, is susceptible to gaps and allows for unwanted air (i.e., drafts), bugs, or the like, originating from the outside environment to enter the structure. Drafting air, especially in the wintertime, may contribute to a drop in temperature within the structure leading to increased heating and energy costs and discomfort.

Thus, it is desirable to provide a device that may be placed about a sliding door system to prevent drafts and unwanted outside annoyances from entering the structure while being easily moved to allow one to freely open and close the sliding door.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate scope thereof. Rather, the primary purpose of this summary is to present some concepts of the disclosure in a simplified form prior to the more detailed description that is presented hereinafter.

In accordance with a preferred embodiment of the disclosure, a draft protector for a sliding door system includes a longitudinally extending body having a front end, a rear end, a top, and a bottom, a longitudinally extending flap portion having a first flap end, a second flap end, and an attachment side, wherein the attachment side is hingedly attached along a portion of the top of the longitudinally extending body and rotatable between engaged and unengaged positions, wherein the longitudinally extending flap portion is configured to substantially fill a recess of the sliding door system in the engaged position and abut at least one door of the sliding door system.

In accordance with a preferred embodiment of the disclosure, described is a method of preventing a draft in a sliding door system comprising: providing a draft protection device having a longitudinally extending body having a front end, a rear end, a top, and a bottom, providing a longitudinally extending flap portion to said device having a first flap end, a second flap end, and an attachment side, wherein the attachment side is hingedly attached along a portion of the top of the longitudinally extending body and rotatable between engaged and unengaged positions, configuring the longitudinally extending flap portion to substantially fill a recess of the sliding door system in the engaged position and abut at least one door of the sliding door system.

Still other aspects of the disclosure will become apparent upon a reading and understanding of the following detailed description.

BRIEF DESCRIPTION OF THE DRAWINGS

The following description and drawings set forth certain illustrative implementations of the disclosure in detail. The illustrated examples, however, are not exhaustive of the many possible embodiments of the disclosure.

DETAILED DESCRIPTION OF THE DISCLOSURE

Figure 1:
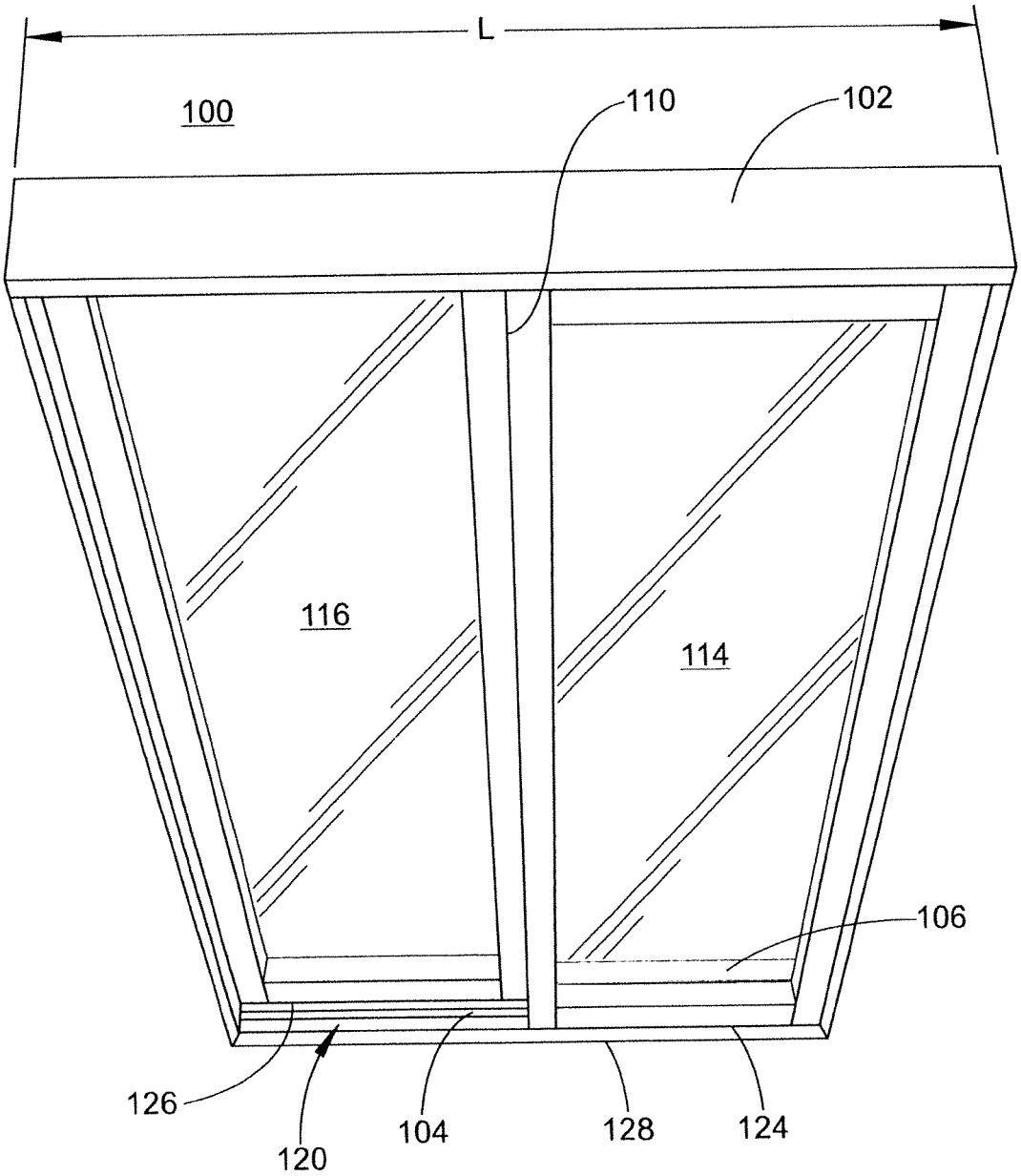
FIG. 1 PRIOR ART
FIG. 1 is a perspective view of a typical existing sliding door system.

A more complete understanding of the articles/devices, processes, and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

FIG. 1 illustrates a typical existing sliding door system 100 often found installed in a structure. The system 100, includes a frame 102, an interior facing track 104, and an exterior facing track 106. The tracks 104 and 106 are parallel and may substantially extend along the entire length L of the frame 102. These door systems often include a first door 114 associated with the interior track 104 and a second door 116 associated with the exterior track 106. The system 100 of FIG. 1 illustrates the first door 114 in a closed position. That is, the first door 114 and second door 116 are arranged such that the combination of the offset doors extend along the length L of the door frame 102. The doors 114 and 116 may overlap at a centralized position 110 of the frame 102 and include a vertically extending seal (not shown) to prevent drafts, debris, and the like from entering the structure between a gap created between the overlapping doors.

The first door 114 is configured to slidably move along the track 104 of the frame 102 from a closed position (as shown in FIG. 1) to an open position (not shown). In the open position, the first door 114, substantially overlaps the position of the second door 116 and provides an open space located where the first door 114 was positioned in the closed state. The open space allows for an exchange between the outside environment and interior environment of the structure allowing for a person to exit or enter the structure. In some systems, the second door 116 is fixed, meaning that it does not slide with respect to positions along its associated track 106. In other systems, the second door 116 is also configured to slidably move along its associated track 106.

It is to be appreciated, that a recess 120 is created due to the offset nature of the first door 114 and second door 116 in the closed position. That is, a portion of the interior track 104 within the recess 108 is unoccupied by the door 114. Drafting air, dust, odors, and pests may enter the structure through gaps between the bottom 124 of first door 114 and its associated track 104 and through gaps between the bottom 126 of second door 116 and its associated track 106 adjacent to the recess 120 formed along door frame base 128.

Figure 2:
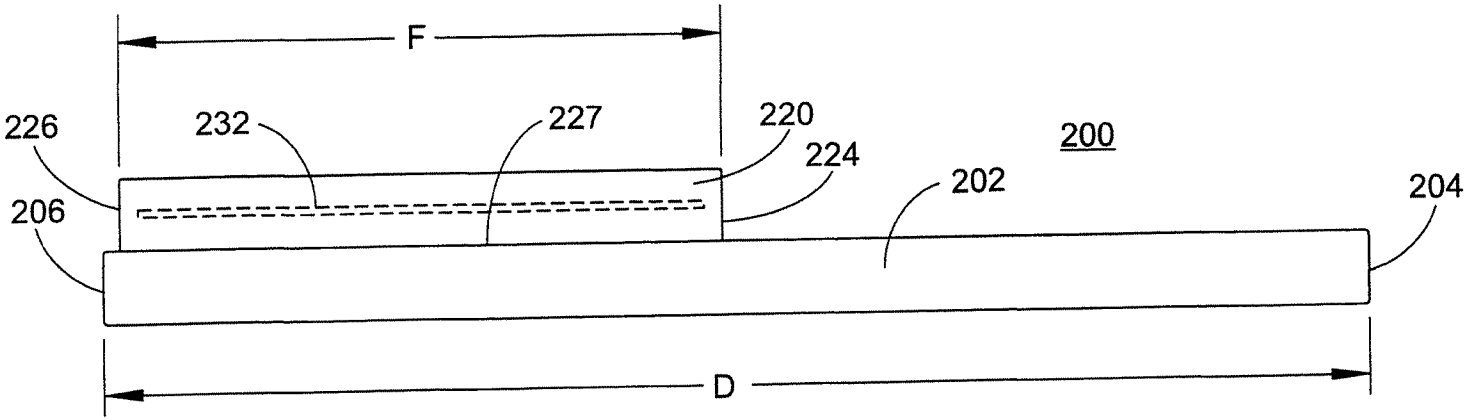
FIG. 2 is a front elevated view of a draft stopper in accordance with the preferred embodiment of the present disclosure.
Figure 3:
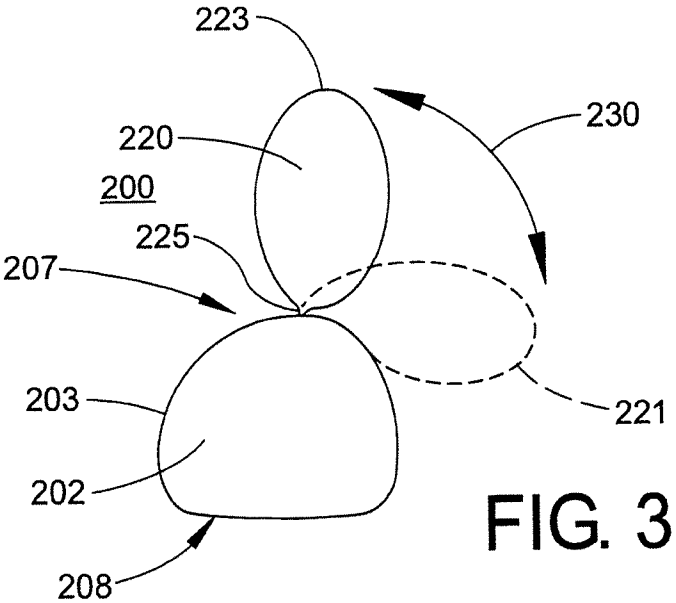
FIG. 3 is a side elevated view of a draft stopper in accordance with the preferred embodiment of the present disclosure.
Figure 4:
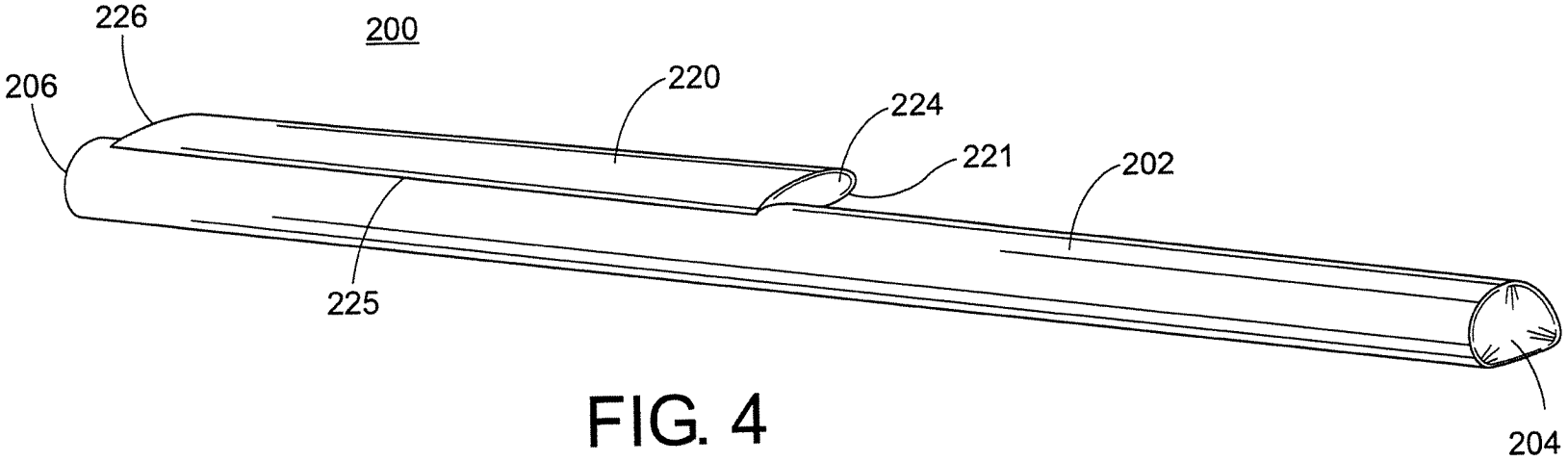
FIG. 4 is a perspective view of a draft stopper in accordance with the preferred embodiment of the present disclosure.

FIGS. 2-4 illustrate a preferred embodiment of a draft stopper 200 of the present disclosure. Of course, variations to the draft stopper are contemplated by the disclosure. The sliding door draft stopper 200 is compatible with the typical sliding door systems illustrated in FIG. 1. The draft stopper 200 preferably includes a longitudinally extending body 202 with a front end 204, a rear end 206, a top portion 207 and bottom portion 208. The longitudinally extending body 202 has a length D extending from the front end 204 to the rear end 206. In some embodiments, the length D of the longitudinally body is greater than the length L of the sliding door system 100. In other embodiments, the length D of the longitudinally body is about equal to the length L of the sliding door system 100. In some embodiments, the length L of the body 202 is from about 65 to about 75 inches. In more particular embodiments, the length L of the body 202 is about 71.5 inches. Thus, length D can vary from 65 to over 75 inches.

The longitudinally extending body 202 preferably includes an exterior body casing 203 configured to contain at least one material therein. That is, the body casing 203 is a bag like structure which is filled with at least one material and then closed. In some embodiments, the body casing 203 is composed of a fabric. In some embodiments, the body casing 203 is composed of a waterproof material. In other embodiments, the body casing 203 is composed of a combination of materials. The body casing 203 defines the shape of the longitudinally extending body 202. In some embodiments, the body casing 203 is substantially cylindrical in shape.

The hollow body casing 203 may contain at least one thermal insulating material. Insulating materials include, but are not limited to fiberglass, wool, cellulose, natural fibers, polystyrene, polyurethane, polyester, cotton, foams, and the like. In some embodiments, the insulating material is composed of polyester.

The body casing 203 may contain at least one weighted material. The weighted material is provided to the body 202 in order to provide resistance of the body 202 to motion. That is, the draft stopper 200 due to its weighted materials stays in place along the edge of a door system and does not move due to incoming drafting air. Weighted materials include but are not limited to sand, gravel, stones and the like, metal beads such as lead, steel, iron, brass, and the like. In some embodiments, the weighted material is sealed within a sack and then the sack is placed within the body casing 203 before sealing the body casing 203. In some preferred embodiments, the body casing 203 contains a combination of insulating and weighted materials.

The sliding door draft stopper 200 also includes a longitudinally extending flap portion 220 with a flap first end 224, a flap second end 226, and a side edge 227. The longitudinally extending flap portion 220 has a length F extending from the flap first end 224 to the rear end flap second end 226. In some embodiments, the length L of the longitudinally extending body 202 is greater than the length F of the flap portion 220. In some embodiments, the length F of the flap portion is from about 30 to about 40 inches long. In some embodiments, the length F of the flap portion is about 34 inches long.

The flap portion 220 may include a flap casing 223 configured to contain at least one material therein. That is, the flap casing 223 is a bag like structure which may be filled with at least one material and then closed and/or sealed. In some embodiments, the flap casing 223 is composed of a fabric. In some embodiments, the flap casing 223 is composed of a waterproof material. In other embodiments, the flap casing 223 is composed of a combination of materials. The flap casing 223 defines the shape of the flap portion 220. In some embodiments, the flap casing 223 is substantially ovalic in shape.

The flap casing 223 may contain at least one thermal insulating material. Insulating materials include, but are not limited to fiberglass, wool, cellulose, natural fibers, polystyrene, polyurethane, polyester, cotton, foams, and the like. In some embodiments, the insulating material is composed of polyester.

The flap casing 223 may contain at least one weighted material. The weighted material is provided within the flap portion 220 in order to keep the flap portion 220 in an engaged position 221 within the sliding door system recess 120 (discussed in greater detail below). Weighted materials include but are not limited to sand, gravel, stones and the like, metal beads such as lead, steel, iron, brass, and the like. In some embodiments, the weighted material is sealed within a sack and then the sack is placed within the flap casing 223 before sealing the flap casing 223. In some preferred embodiments, the flap casing 223 contains a combination of insulating and weighted materials.

The flap portion 220 is hingedly connected at connection living hinge 225 along the side edge 227 to a portion of the top 207 of the longitudinally extending body 202. The hinged connection allows the flap portion 220 to rotate about the connected side edge 227 in the direction of the arrow 230 of FIG. 2. That is, the flap portion 220 may rotate from an unengaged position, shown in FIG. 3, to an engaged position shown in FIG. 4 and the dotted outline 221 of FIG. 3.

In some embodiments, the hinged attachment 225 is made by fastening the body 202 and flap portion 220 together along the side edge 227 and top 207 using stitches, such as those made in sewing. In other embodiments, the body 202 and flap portion are bonded together along side edge 227 with an adhesive.

In some embodiments, the body 202 and flap portion 220 are removably attached. That is, the flap portion 220 may be easily removed and attached to the longitudinally extending body 202. In some embodiments, the removable attachment is a hook and loop attachment. In other embodiments, the removable attachment may be provided by a plurality of snap fasteners along the side edge 227 and corresponding fasteners positioned along a portion of the top 207. In still other embodiments, the longitudinally extending body 202 and flap portion 220 may be attached by a clasp locker, commonly known as a zipper.

When the longitudinally extending body 202 is laid against the bottom edge 128 of the sliding door frame 102 the longitudinally extending body 202 abuts the bottom edge 124 of the first door 114 and along the length L of the frame 102. The flap portion 220 may be moved to the engaged position 221 of FIGS. 3 and 4. In the engaged position 221, the flap portion 220 occupies the recess 120 and abuts the bottom edge 126 of the second door 116. In this way, the draft stopper 200 is positioned to prevent unwanted air, debris, etc. from entering the structure through gaps between the bottoms 124 and 126 of doors 114 and 116, respectively.

The hinged attachment 225 also allows a person to easily move the flap portion 220 from an engaged position to an unengaged position and allow for opening of the sliding door system 100. That is, in some instances, the flap portion 220 may hinder the first door 114 from sliding along its associated tack 104 (within the recess 120) to an open position unless the flap portion 220 is moved to its unengaged position.

In some embodiments, the flap portion 220 may contain a longitudinally extending rod 232 within the flap casing 223. The rod 230 provides rigidity and a security feature when the flap 220 is in an engaged position that prevents the door 114 from sliding to an open position along the track 104. In this way, unwanted intruders may be thwarted by the security measure when trying to enter a structure through the sliding door system. The rod 232 may be made of wood, metal, or the like.

In some embodiments, rear end 206 of the body 202 extends beyond the flap second end 226 of the flap portion 220. In this way, the longitudinally extending body 202 may extend along the base 128 of the door frame 102 past the recess portion 120 for additional thermal coverage of the frame.

Example

Figure 5:
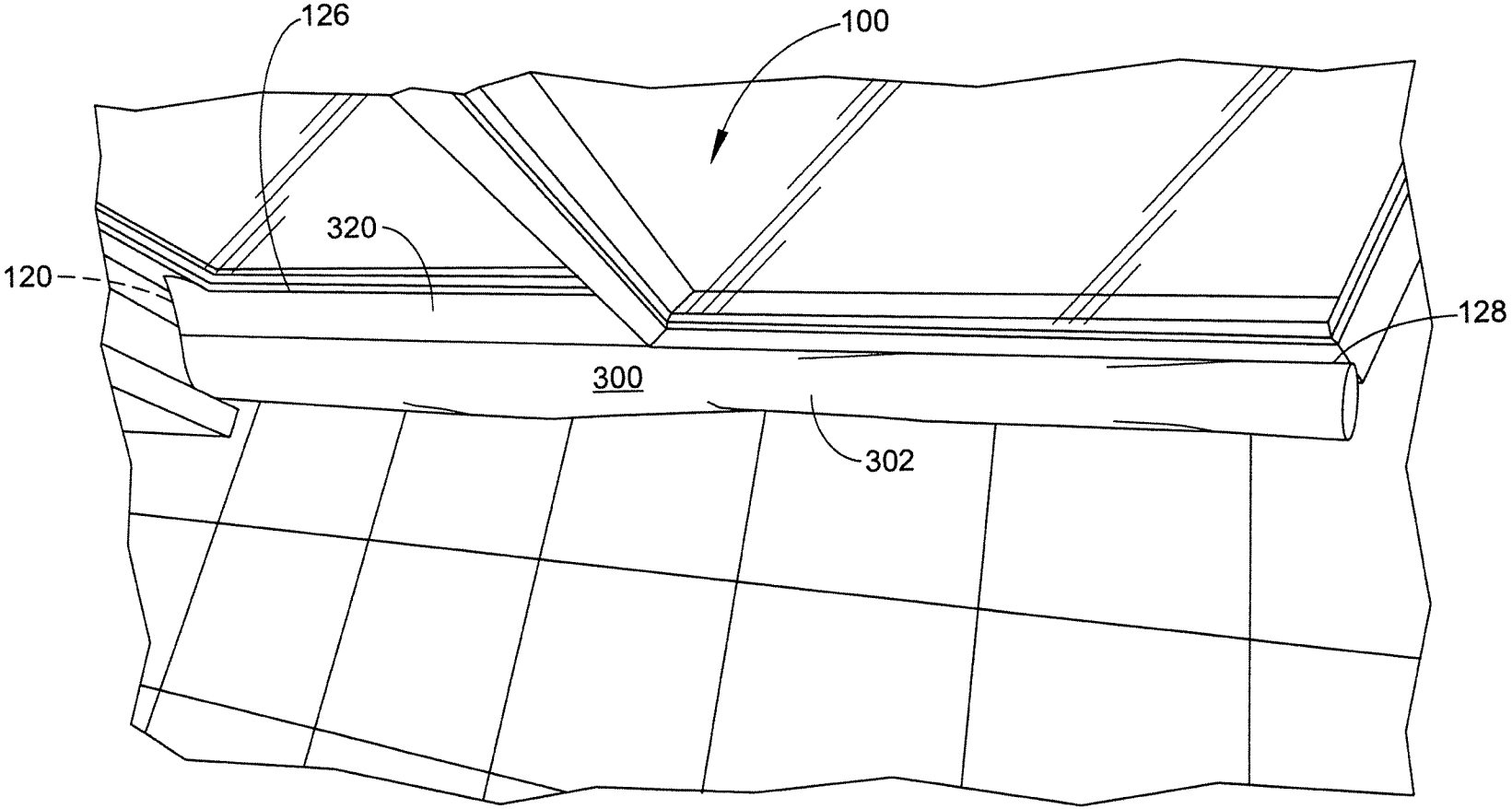
FIG. 5 is a perspective view of the draft stopper of the preferred embodiment of the present disclosure positioned about a sliding door system.

FIG. 5 shows a sliding door stopper 300 installed with a door system in accordance with the preferred embodiment of the disclosure. The sliding door draft stopper 300 prevents unwanted drafts, debris, etc. from entering a residence via gaps about the base of each door. FIG. 5 shows the longitudinally extending body 302 positioned along the bottom edge of the door frame with the flap portion 320 in an engaged position and substantially filling the recess of the door system 100.

The body casing and flap casings are preferably made with a fabric and filled with polyester for thermal insulation and bags of gravel for weight. The body 302 is about 71.5 inches long and about 4 inches high. The flap portion 320 is about 34 inches long and about 4 inches wide.

The exemplary embodiments have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A draft protector for a two door sliding door system comprising:

a longitudinally extending body having a front end, a rear end, a top, and a bottom;

a longitudinally extending flap portion having a first flap end, a second flap end, and an attachment side, wherein the attachment side is attached via a living hinge connection along a portion of the top of the longitudinally extending body and rotatable between engaged and unengaged positions;

wherein the longitudinally extending body is positioned facing a first portion of the sliding door system and a first door of the two door sliding door system and the longitudinally extending flap portion is configured to substantially fill a recessed portion of the sliding door system in the engaged position and abuts a second door of the sliding door system; and wherein each of said longitudinally extending body and said longitudinally extending flap portion are positioned on a same side of said sliding door system in said engaged position when said first door and said second door are in a closed position.

2. The draft protector according to claim 1 wherein the longitudinally extending body is substantially cylindrical in shape.

3. The draft protector according to claim 1, wherein the longitudinally extending body comprises a body casing configured to contain at least one filling material.

4. The draft protector according to claim 3, wherein the at least one filling material is polyester.

5. The draft protector according to claim 3, wherein the body casing is configured to contain at least one weight material.

6. The draft protector according to claim 5, wherein the weight material is gravel bags.

7. The draft protector according to claim 3 wherein, the body casing comprises a fabric.

8. The draft protector according to claim 1, wherein the flap portion comprises a flap casing configured to contain at least one filling material.

9. The draft protector according to claim 8, wherein the at least one filling material is polyester.

10. The draft protector according to claim 8, wherein said flap casing is configured to contain at least one weight material.

11. The draft protector according to claim 10, wherein the weight material is gravel bags.

12. The draft protector according to claim 8, wherein said flap casing comprises a fabric.

13. The draft protector according to claim 1, wherein the rear end extends beyond the second flap end.

14. The draft protector according to claim 1, wherein the front end extends beyond the first flap end.

15. The draft protector according to claim 1, wherein the longitudinally extending body is about 71.5 inches long.

16. The draft protector according to claim 1, wherein the longitudinally extending body is about 4 inches high.

17. The draft protector according to claim 1, wherein the flap portion is about 34 inches long.

18. The draft protector according to claim 1, wherein the flap portion is about 4 inches wide.

19. The draft protector according to claim 1, wherein the flap portion comprises a longitudinally extending rod.

20. A method of preventing a draft in a two door sliding door system comprising:

providing a draft protection device having a longitudinally extending body having a front end, a rear end, a top, and a bottom;

providing a longitudinally extending flap portion to said device having a first flap end, a second flap end, and an attachment side, wherein the attachment side is attached via a living hinge along a portion of the top of the longitudinally extending body and rotatable between engaged and unengaged positions;

configuring said longitudinally extending body to face a first door of said two door sliding door system along a length of the first door of said sliding door system;

rotating and configuring the longitudinally extending flap portion to substantially fill a recess of the sliding door system in the engaged position and abut a second door of the sliding door system;

wherein said flap portion and said longitudinally extending body are positioned on a same side of said sliding door system in said engaged position when said first door and second door are in a closed position.

* * * * *